US011332902B2

(12) United States Patent
Moriyama et al.

(10) Patent No.: US 11,332,902 B2
(45) Date of Patent: May 17, 2022

(54) SCOUR PREVENTION UNIT AND SCOUR PREVENTION METHOD

(71) Applicants: SUMITOMO CORPORATION, Tokyo (JP); KYOWA CO., LTD., Osaka (JP)

(72) Inventors: Ikuo Moriyama, Osaka (JP); Kotaro Oda, Osaka (JP); Shigeru Matsuo, Osaka (JP); Koji Kajiwara, Osaka (JP); Hironori Kawamura, Osaka (JP)

(73) Assignees: SUMITOMO CORPORATION, Tokyo (JP); KYOWA CO., LTD., Osaka (JP)

( * ) Notice: Subject to any disclaimer, the term of this patent is extended or adjusted under 35 U.S.C. 154(b) by 0 days.

(21) Appl. No.: 16/968,305

(22) PCT Filed: Feb. 9, 2018

(86) PCT No.: PCT/JP2018/004639
§ 371 (c)(1),
(2) Date: Aug. 7, 2020

(87) PCT Pub. No.: WO2019/155612
PCT Pub. Date: Aug. 15, 2019

(65) Prior Publication Data

US 2021/0079616 A1 Mar. 18, 2021

(51) Int. Cl.
*E02B 3/04* (2006.01)
*E02B 17/00* (2006.01)
*E02B 3/12* (2006.01)

(52) U.S. Cl.
CPC ..... *E02B 17/0017* (2013.01); *E02B 3/12* (2013.01)

(58) Field of Classification Search
CPC ..... E02B 3/04; E02B 3/12; E02B 3/127; E02B 17/0017; E02D 29/0208
See application file for complete search history.

(56) References Cited

U.S. PATENT DOCUMENTS 3,474,626 A * 10/1969 Colle ..... E02B 3/127 405/18
3,524,320 A * 8/1970 Turzillo ..... E02B 3/127 405/18
3,696,623 A * 10/1972 Heine ..... E02B 3/126 405/19

(Continued)

FOREIGN PATENT DOCUMENTS

JP H08284132 A 10/1996
JP H0921123 A 1/1997

(Continued)

OTHER PUBLICATIONS

International Search Report issued in corresponding International Application No. PCT/JP2018/004639, dated Apr. 24, 2018, pp. 1-2, Japan Patent Office, Tokyo, Japan.

(Continued)

*Primary Examiner* — Benjamin F Fiorello
(74) *Attorney, Agent, or Firm* — Hauptman Ham, LLP

(57) ABSTRACT

A scour prevention unit includes a bag body housing block objects in a bag material, and a cloth integrated with the bag body, wherein the cloth is housed in the bag material and is laid below the block objects, or is fixed below the bag body outside the bag body by fixing means.

7 Claims, 7 Drawing Sheets

(56) References Cited

U.S. PATENT DOCUMENTS 4,571,121 A * 2/1986 Albert ..... E02B 17/02 405/15
4,594,206 A * 6/1986 Grafton ..... E02B 3/06 264/257
4,655,637 A * 4/1987 Vignocchi ..... E02D 17/20 405/17
4,690,585 A * 9/1987 Holmberg ..... E02B 3/127 405/15
5,125,767 A * 6/1992 Dooleage ..... E02B 3/108 405/114
5,158,395 A * 10/1992 Holmberg ..... E02B 3/127 405/15
5,762,448 A * 6/1998 Bilanin ..... E02B 17/0017 405/73
5,951,202 A * 9/1999 Brown ..... E02B 3/122 405/19
6,027,285 A * 2/2000 Angel ..... E02B 3/123 405/158
6,305,876 B1 * 10/2001 Yoshino ..... E02B 17/0017 405/17
7,357,598 B1 * 4/2008 Bradley ..... E02B 3/108 405/15
9,562,350 B1 * 2/2017 Witt ..... B01D 29/071
2002/0090265 A1 * 7/2002 Merten ..... E02B 3/127 405/18
2007/0003369 A1 * 1/2007 Hanson ..... E02B 3/04 405/19
2007/0041793 A1 * 2/2007 Moss ..... E02D 29/0208 405/284
2008/0264546 A1 * 10/2008 Olsta ..... E02D 31/004 156/91
2010/0111611 A1 * 5/2010 Olsta ..... E02D 31/004 405/128.1
2011/0158747 A1 * 6/2011 Ohkubo ..... F03D 13/22 405/157
2011/0158751 A1 * 6/2011 Ohkubo ..... F03D 13/22 405/224
2011/0158753 A1 * 6/2011 Ohkubo ..... E02D 15/10 405/302.6
2012/0134756 A1 * 5/2012 Heselden ..... E02D 29/0216 405/273
2014/0010601 A1 1/2014 Bradley, Sr. et al.
2014/0119836 A1 * 5/2014 Thompson ..... E02D 17/202 405/195.1
2016/0002872 A1 * 1/2016 Gallagher ..... E02B 3/126 405/17
2017/0284046 A1 * 10/2017 Abeles ..... E02B 3/108
2019/0075738 A1 * 3/2019 Manning ..... A01G 24/50
2019/0177942 A1 * 6/2019 Serna Garc a-Conde ..... E02D 27/52
2019/0234042 A1 * 8/2019 Burkett ..... E02B 3/124
2020/0385945 A1 * 12/2020 Zaccardi ..... E02B 3/04
2020/0399846 A1 * 12/2020 Abeles ..... E02B 3/108

FOREIGN PATENT DOCUMENTS

JP H11241326 A 9/1999
JP 2001262577 A 9/2001
JP 2001271322 A 10/2001
JP 2002121720 A 4/2002
JP 2012162884 A 8/2012
JP 2015031148 A 2/2015
JP 2015218552 A 12/2015
JP 2016079554 A 5/2016
JP 2017227056 A 12/2017
JP 2018155040 A 10/2018
KR 1020130051565 A 5/2013
KR 101320455 B1 10/2013

OTHER PUBLICATIONS

Extended European Search Report issued in corresponding European Application No. 18905852.2, dated Jul. 12, 2021, pp. 1-8, Munich, Germany.
Japanese Office Action issued in corresponding Japanese Patent Application No. 2019-570246, dated Nov. 30, 2021, pp. 1-8.

* cited by examiner

SCOUR PREVENTION UNIT AND SCOUR PREVENTION METHOD

CROSS-REFERENCE TO RELATED APPLICATIONS

The present application is a National Phase of International Application Number PCT/JP2018/004639, filed Feb. 9, 2018, which is hereby incorporated by reference in its entirety.

TECHNICAL FIELD

The present invention relates to a scour prevention unit, and in particular, relates to a scour prevention unit used for scour prevention at the foundation of a windmill for offshore wind power generation.

BACKGROUND ART

There conventionally have been methods for configuring a structural body using a suction prevention sheet to prevent scouring at rivers and levees. Such examples are disclosed in Japanese Unexamined Patent Publications No. 2001-262577 (Patent Document 1), No. 2002-121720 (Patent Document 2), and No. 2015-31148 (Patent Document 3).

Patent Document 1 discloses a configuration installing a suction prevention sheet accurately and firmly to a support frame, and on a suction prevention sheet laid on the foundation ground, disposing a huge stacking work (indicative of sandbag stacking work, basket stacking work and the like that is shaped rectangular or elliptic having a volume of at least about two cubic meters) to establish mechanized construction, and further simultaneously constructing a stacking work portion and a banking portion completely separated by the support frame and the suction prevention sheet to strive for shortening the working period.

Patent Document 2 discloses a configuration in which a basket drain section is formed on a land side of a levee body, which basket drain section causes infiltration water of the levee body to flow therein by a filling basket filled with rough grain filter material in a steel assembly net, to form a drain layer by covering rough grain filter material on a foundation ground between this basket drain section and a levee foot waterway at the foot of a slope, and this basket drain section and drain layer is covered with levee soil, and the infiltration water flown into the basket drain section is guided to the levee foot waterway through the drain layer.

Patent Document 3 discloses a configuration including an outer cylindrical body disposed within a top-covered coating concrete of a levee body, a lid body that usually tightly closes an upper opening of the outer cylindrical body, a settlement plate that settles in the outer cylindrical body along with the settlement of levee soil, and a check valve, wherein the lid body is detachable by being blown away by compressed air generated within the outer cylindrical body by lifting pressure received by the levee due to an increase in water level.

On the other hand, there are cases using only a conventional bag body containing crushed stone without using a suction prevention sheet. This case is described in detail. FIG. 7 shows a cross-sectional view of a case in which a bag body 101 containing only crushed stone is disposed at the root of a pier in a river 110, without using a suction prevention sheet. Moreover, FIG. 8 shows a cross-sectional view of a case in which bag bodies 102 containing only crushed stone are disposed at the bottom of the river, for bank protection of the river 110.

CITATION LIST

Patent Literatures

[Patent Document 1] Japanese Unexamined Patent Publication No. 2001-262577 (Abstract etc.)
[Patent Document 2] Japanese Unexamined Patent Publication No. 2002-121720 (Abstract etc.)
[Patent Document 3] Japanese Unexamined Patent Publication No. 2015-031148 (Abstract etc.)

SUMMARY OF INVENTION

Technical Problem

A conventional bag body for scour prevention containing only crushed stone was configured as described above, and was placed at the bottom of the river 112. In the case of the bottom of the river 112, sediments of minute particles are usually carried by the waterflow of the river and only sediments of particles greater than a certain size remain. Therefore, just disposing the conventional bag body containing only crushed stone achieves the scour protecting function.

FIGS. 9(A) to 9(C) are views for describing the problems in a case of using the conventional bag body 101 containing only crushed stone at the seabed. FIG. 9(A) shows an initial state of the bag body 101 containing only crushed stone being placed on a surface 122*a* of a sand layer 122, in a case in which the sand layer 122 exists on a surface 121*a* of a clay layer 121 of the seabed 120, FIG. 9(B) shows a state after elapse of a predetermined period, and FIG. 9(C) is a view showing a final placed state. In a case of disposing the conventional bag body 101 containing only crushed stone for the purpose of scour protection around a structure disposed on the seabed as like in FIG. 9(A), since sand of minute particles accumulate on the seabed to form the sand layer 122, as time elapses, the sand in the sand layer 122 is suctioned above (shown by curved line in the arrows in the drawing) from below the bag body 101 by a tide 124 flowing above the bag body 101 as in FIG. 9(B), and as time elapses further, the bag body 101 containing only crushed stones sinks to the clay layer 121 as a result of having no sand left as in FIG. 9(C). As a result, there was the problem that a seabed structure 123 cannot be supported vertically, and thus the seabed structure 123 inclines (in FIG. 9(C), the surface 122*a* of the original sand layer is shown in dotted lines, and the sea surface is shown as 125).

Moreover, if this is simply a method of scattering crushed stone separately, there was the problem that it would take extra time and cost in the case of a small-scale construction, and that under an environment with fast tide and high waves, the crushed stone will become carried away, thus being unable to prevent scouring.

This invention is accomplished in view of the above problems, and an object thereof is to provide a scour prevention unit that causes no infiltration of sand from below a placement surface of a scour prevention unit as like a bag body housing block objects such as crushed stone.

Solution to Problem

A scour prevention unit according to this invention includes a bag body housing block objects in a bag material, and a cloth integrated with the bag body. The cloth is laid below the block objects housed in the bag material, or is fixed below the bag body outside the bag body by fixing means.

Preferably, the cloth is one in which fibers of a woven fabric, knitted fabric (knit fabric), lace, felt, or nonwoven fabric are processed into a thin and broad sheet.

In other aspects of this invention, the scour prevention unit includes a bag body housing block objects in a bag material and a cloth integrated with the bag body, wherein the cloth is laid below the block objects housed in the bag material while also is fixed below the bag body outside the bag body by fixing means.

In other aspects of this invention, a scour prevention method includes a step of preparing a bag body housing block objects in a bag material; and a step of integrating the bag body with a cloth. The step of integrating the bag body with the cloth includes a step of housing the cloth in the bag material and laying the cloth below the block objects, or fixing the cloth below the bag body outside the bag body by fixing means.

Advantageous Effects of Invention

In this invention, since the cloth is housed in the bag material and laid below the block objects, or is fixed below the bag body outside the bag body by fixing means, even if the bag body is placed on a sandy place, sand will not infiltrate upwards through the bag body.

As a result, it is possible to provide a scour prevention unit in which no suction of sand occurs from the bottom of a placement surface of the bag body including block objects such as crushed stone.

DESCRIPTION OF EMBODIMENTS

Figure 1:
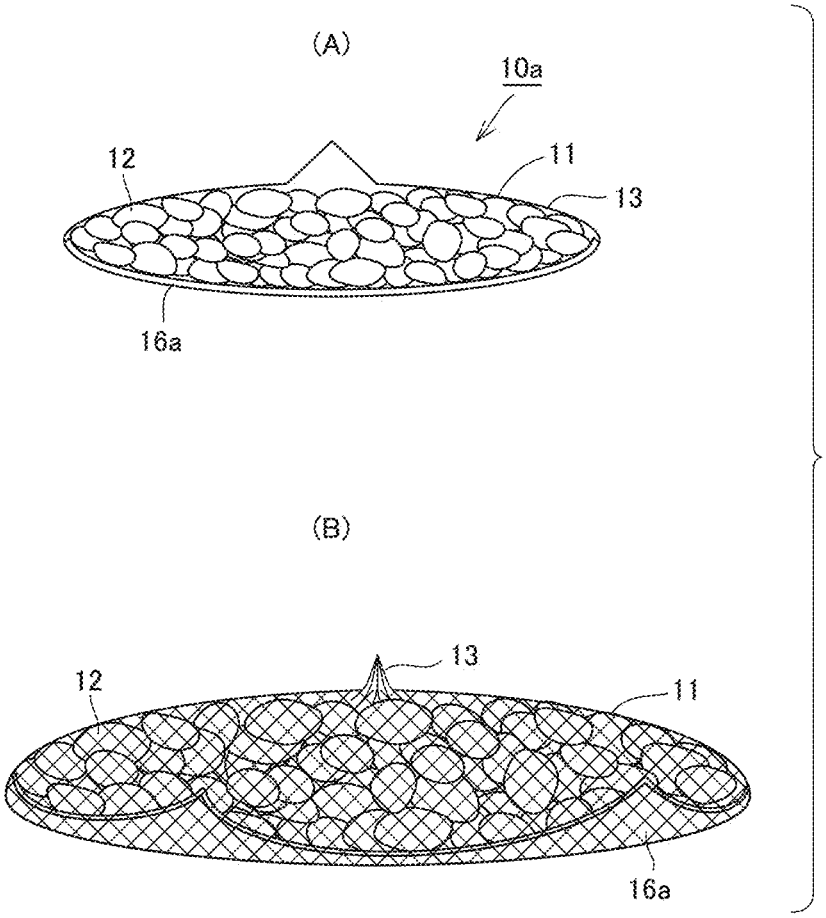
FIG. 1 is a schematic view showing a first embodiment of a scour prevention unit according to an embodiment of this invention.

An embodiment of this invention will be described below in details, with reference to the drawings. In an embodiment of this invention, a scour prevention unit 10 includes a bag body 11 housing block objects 12 such as a plurality of crushed stone in a bag material 13, and a cloth 16 integrated with the bag body 11. Here, the cloth is indicative of one in which a plurality of fibers is processed into a thin and broad sheet. Depending on the manufactured method, the cloth is classified into woven fabric, knitted fabric (knit fabric), lace, felt, and nonwoven fabric.

The block objects are crushed stone, concrete blocks, cobblestones, broken stones, ironstone, rubber tire and the like having a specific gravity exceeding 1, preferably not less than 1.5, more preferably not less than 2.0. Moreover, the bag material is one configured by a net.

FIG. 1 is a schematic view of a scour prevention unit 10*a* according to a first embodiment. FIG. 1(A) is a cross-sectional view, and FIG. 1(B) is a perspective view. With reference to FIGS. 1(A) and 1(B), the scour prevention unit 10*a* includes a bag body 11 which houses block objects 11 in a bag material 13 with block objects 11 placed on a cloth 16 and is placed on the seabed. In FIG. 1(B), the cloth 16 is made larger than a placement surface of the bag body 11, and displays a state in which one part is viewable from top view. FIG. 1(B) shows in white a part in which one portion 16*a* of the cloth 16 is covering the block objects inside, shows the block objects 12 at center parts, and shows a state in which the mesh-form bag material 13 covers by the whole.

This is preferable for fixing the cloth 16 to the bag body 11, to securely house the cloth 16 below the block objects 12 and also to prevent the cloth 16 from moving inside the bag body 11. To fix the cloth to the bag body 11, a string with a hook may be provided for example at edges of four corners or in its vicinity of the cloth 16, to use this hook to fix the bag body 11 at predetermined locations. Moreover, the cloth 16 is preferably larger than the placement surface of the bag body 11 (circular projected plane of the scour prevention unit 10*a* in FIG. 2(B), described later).

By configuring as such, the block objects 12 will be placed and maintained on the cloth 16 within the bag body 11; hence, even if the bag body is placed on a sandy place, sand will not infiltrate upward through the bag body 11.

As a result, it is possible to provide a scour prevention unit in which no suction of sand occurs from below the placement surface of the bag body containing crushed stone.

Figure 2:
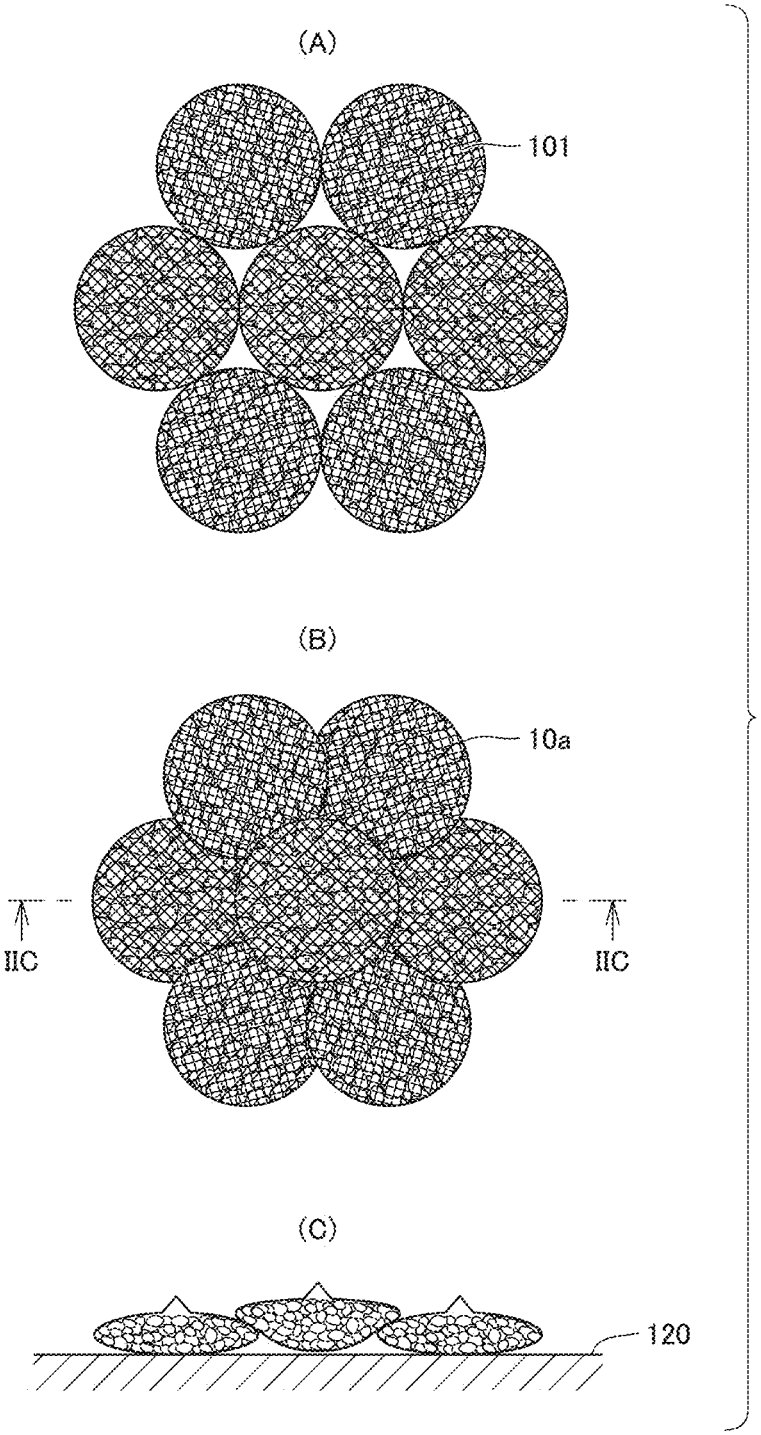
FIG. 2 is a plan view showing a set state of the scour prevention unit of the first embodiment.

Next describes a setting method in a case of setting a plurality of the scour prevention units 10*a* according to the first embodiment. FIG. 2(A) is a plan view showing a conventional method of setting the bag body 101, and FIG. 2(B) is a plan view showing a method according to this embodiment of setting the scour prevention unit 10*a*. In a case of setting a plurality of the conventional bag bodies 101, the bag bodies were arranged on the seabed with no parts overlapping and so that their peripheries touch each other. In comparison, in a case of setting a plurality of the scour prevention units 10*a* according to the first embodiment, the plurality of scour prevention units 10*a* are arranged on the seabed 120 so as to overlap each other, as shown in FIG. 2(B). FIG. 2(C) is a cross-sectional view taken on IIC-IIC in FIG. 2(B).

By arranging as such, it is possible to prevent the suction of sand from the seabed more effectively.

Figure 3:
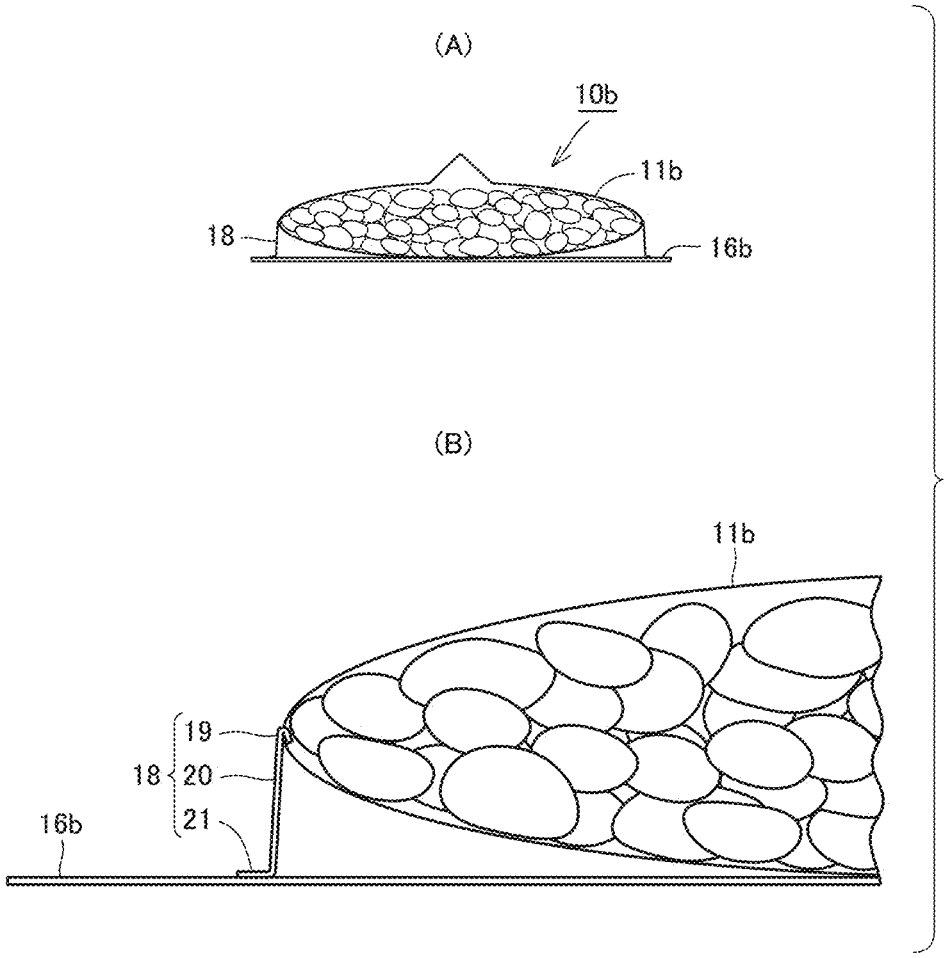
FIG. 3 is a schematic view showing a second embodiment of the scour prevention unit according to an embodiment of this invention.

Next describes a scour prevention unit 10*b* according to a second embodiment. FIG. 3 is a schematic view showing the scour prevention unit 10*b* according to the second embodiment. FIG. 3(A) is a cross-sectional view, and FIG. 3(B) is a view showing details of a fixing portion of the bag body 11 to the cloth 16, which bag body 11 contains the block objects 12.

With reference to FIGS. 3(A) and 3(B), in this embodiment, the cloth 16 is integrated and fixed below the bag body 11 containing the block objects 12. The fixing means 18 includes an attachment string 20 having on its tip a hook 19 to attach on the periphery of the bag body 11, and has a fixing part 21 that fixes one part of the cloth 16*b* to an end of the attachment string 20 not having the hook 19 attached. In this embodiment, one fixing means 18 is provided for one bag body 11, however this number may be increased if necessary.

In this embodiment, since the scour prevention unit 10*b* has the cloth 16 provided integrally below the bag body 11 by the fixing means 18, the scour prevention unit 10*b* is placed on the seabed in a state in which the cloth 16 is laid below the block objects 12. Even if the bag body 11 is placed on a sandy place, the cloth 16 is below the bag body 11, so the sand will not infiltrate upwards through the bag body 11. As a result, it is possible to provide a scour prevention unit in which no suction of sand occurs from below the placement surface of the bag body 11 containing the block objects 12.

Since the cloth 16 is preferably water-permeable, a nonwoven fabric or mesh sheet is preferable. In the case of the mesh, the eye of the mesh is preferably sized as 5 mm, and more preferably is not more than 2 mm.

Next describes a setting method in the case of setting the scour prevention unit 10*b* according to the second embodiment. FIG. 4(A) is a plan view showing the cloth 16 of a rectangular shape arranged below the scour prevention unit 10, FIG. 4(B) is a plan view showing a state arranging the bag body 11 of a bun shape on the rectangular cloth 16 shown in FIG. 4(A), and FIG. 4(C) is a plan view of a case of arranging three bag bodies 11 adjacent to each other on the rectangular cloth 16. Moreover, a cross-sectional view of the arrangement of FIG. 4(C) is shown in FIG. 5.

Figure 4:
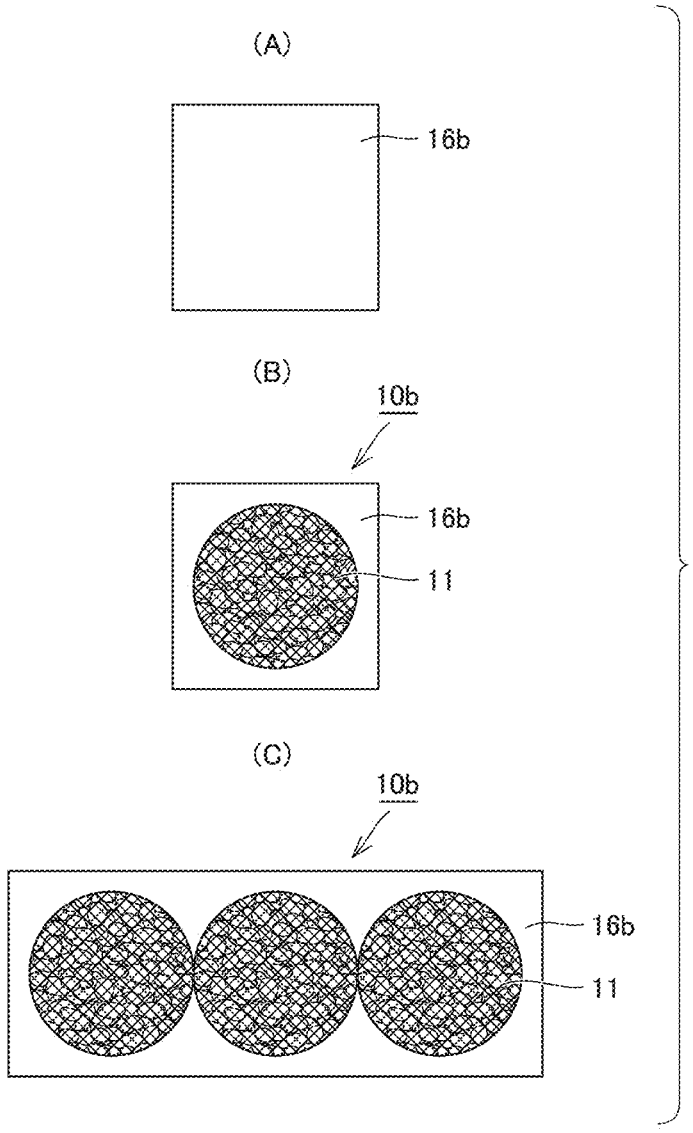
FIG. 4 is a plan view showing a set state of the scour prevention unit of the second embodiment.
Figure 5:
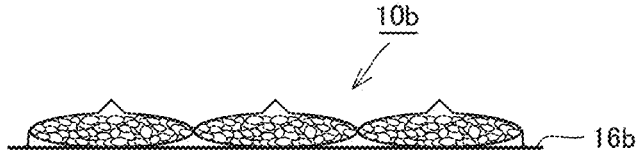
FIG. 5 is a side view showing a set state of the scour prevention unit of the second embodiment.

With reference to FIGS. 4 and 5, in this embodiment, since a plurality of bag bodies 11*a* is placed on one piece of cloth 16*a*, it is possible to place a plurality of bag bodies 11 at once. In this case, each of the plurality of bag bodies 11 is preferably fixed to the rectangular cloth 16 individually by using the fixing means as like those shown in FIG. 3(B). The three bag bodies may be connected in the lateral direction in advance and then be fixed to the cloth.

Moreover, this embodiment describes a case of arranging three bag bodies adjacent to each other on one rectangular cloth, however it is not limited to this; two, or four or more may be placed. Furthermore, a case of placing in a line in one direction is described, however it is not limited to this, and may be aligned in array form in vertical and horizontal directions.

Figure 6:
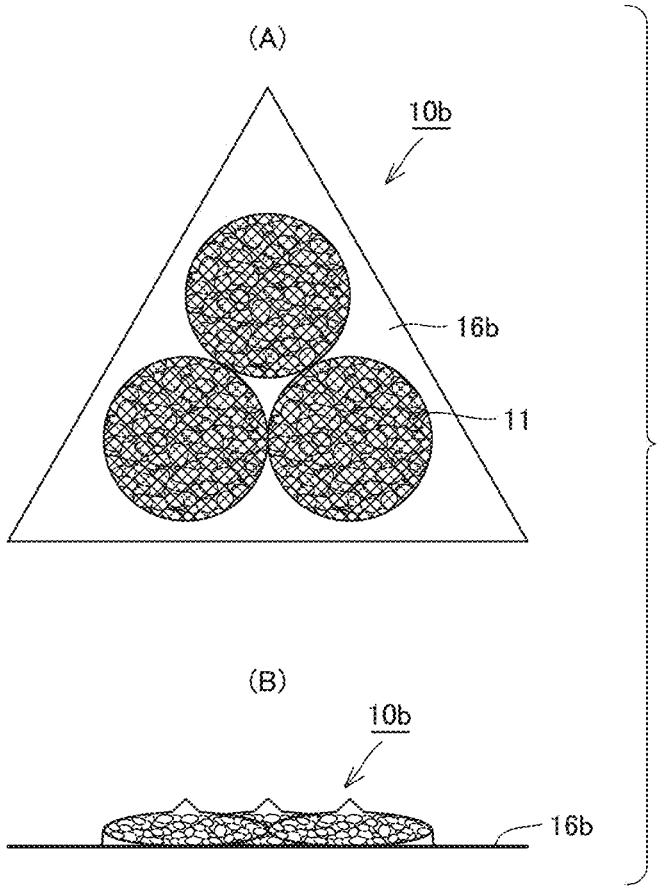
FIG. 6 is a view showing a specific set state of the scour prevention unit of the second embodiment.
Figure 7:
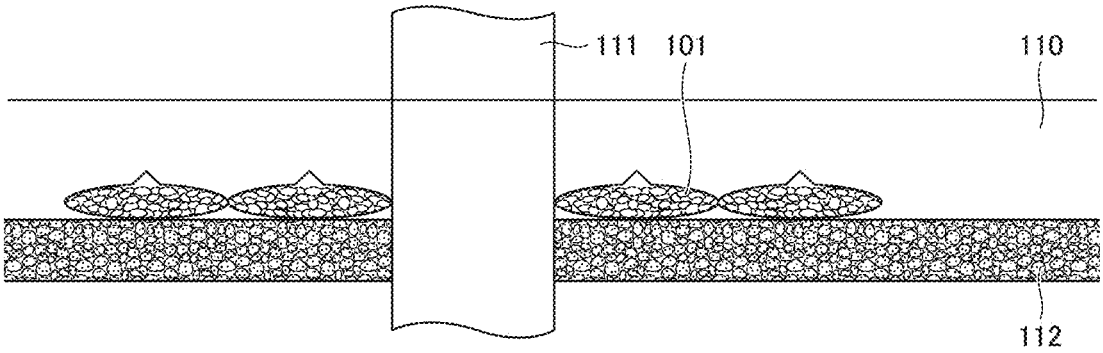
FIG.7 PRIOR ART
FIG. 7 is a view showing a setting example of a conventional bag body containing crushed stone only.
Figure 8:
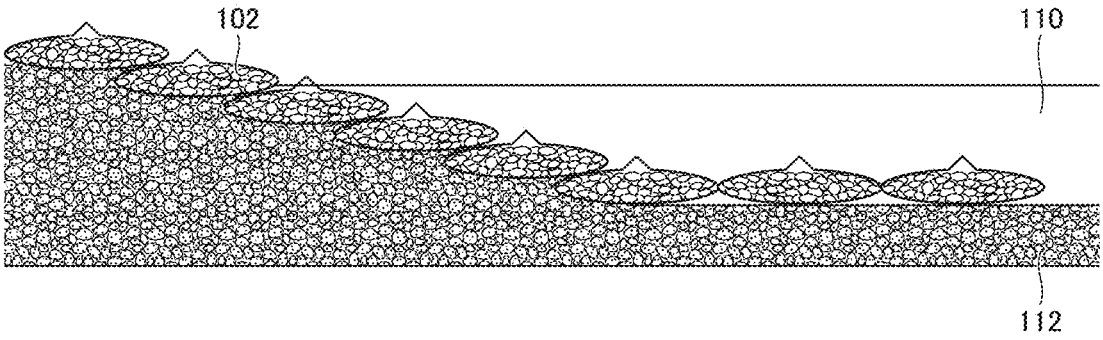
FIG.8 PRIOR ART
FIG. 8 is a view showing a setting example of a conventional bag body containing crushed stone only.
Figure 9:
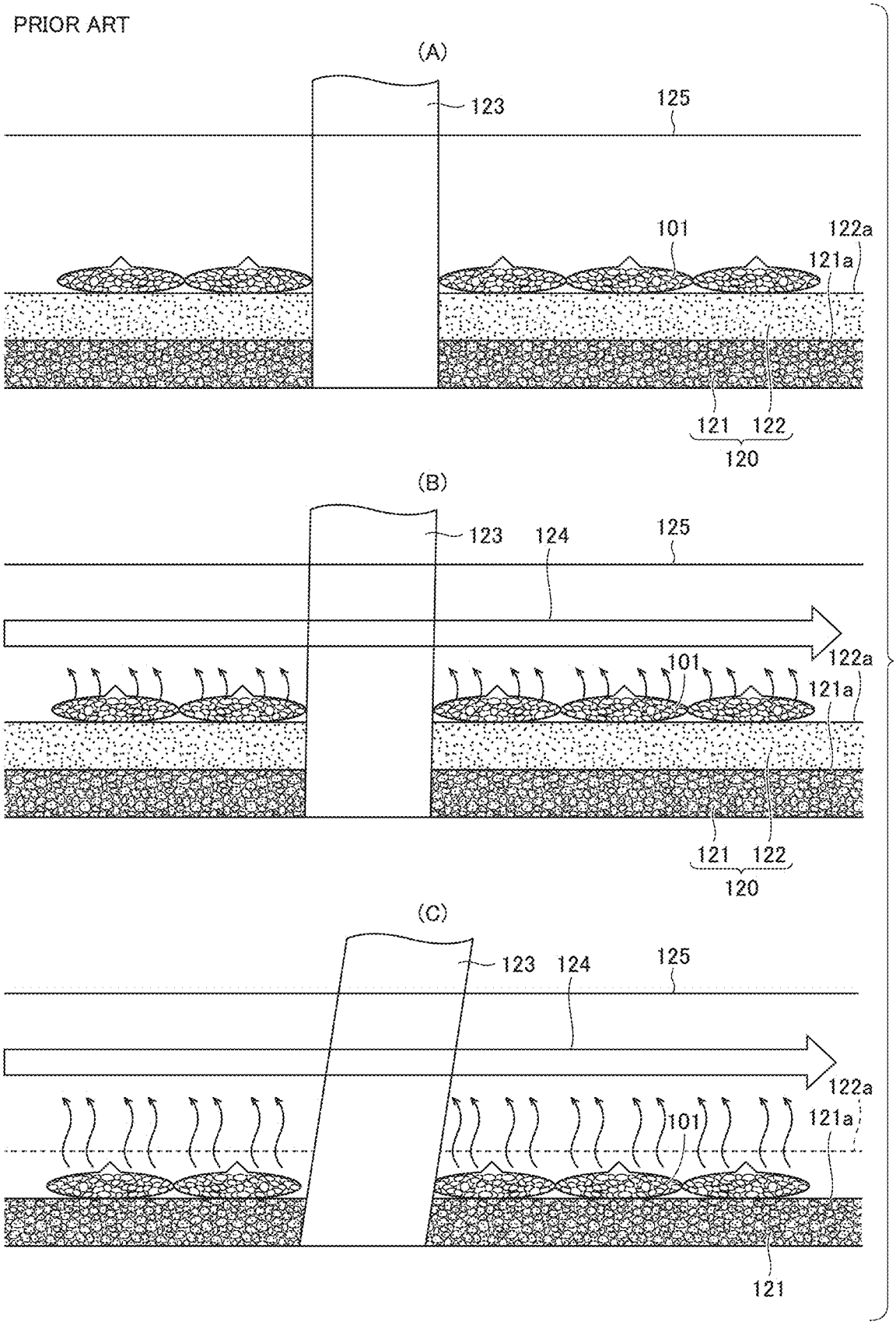
FIG.9 PRIOR ART
FIG. 9 is a view showing a setting example of a conventional bag body containing crushed stone only.

Next describes a setting method in a case of setting the scour prevention unit 10*b* according to a third embodiment. FIG. 6(A) is a plan view showing a triangular cloth 16*b* arranged below the scour prevention unit 10, and FIG. 6(B) is a cross-sectional view showing a state arranging the bun-shaped bag body 11 on the triangular cloth 16*b* shown in FIG. 6(A). As shown in FIGS. 6(A) and 6(B), three bag bodies 11*b* are arranged adjacent to each other on the triangular cloth 16*b*. In this embodiment also, since a plurality of the bag bodies 11*b* are placed on one piece of the cloth 16*b*, it is possible to place a plurality of the bag bodies 11*b* at once. In this case, each of the plurality of the bag bodies 11 is preferably fixed on the triangular cloth 16*b* individually, by using the fixing means as like those shown in FIG. 3(B). The three bag bodies may be connected at their adjacent sides in advance, and then fixed to the cloth 16*b*.

Moreover, this embodiment describes a case of arranging three bag bodies on the one triangular cloth, having one bag body positioned upper and two bag bodies positioned lower and adjacent to each other, however it is not limited to this; any polygonal shape may be used, or a circular cloth may be used and any number of bag bodies may be placed thereon.

By arranging the bag bodies 11 on the cloth 16 as such, it is possible to effectively prevent the suction of sand from the seabed, as with the previous embodiment.

Moreover, in this embodiment, a cloth of any desired shape may be prepared, and any number of bag bodies may be fixed thereon.

The embodiment described above describes a case in which, in the scour prevention unit, the cloth is either housed in the bag material and laid below the block objects or is fixed below the bag body outside the bag body by the fixing means, however it is not limited to this. The cloth may be housed in the bag material and laid below the block objects, while also having the cloth be fixed below the bag body outside the bag body by the fixing means Having such configuration will further effectively prevent the suction of sand from the seabed.

The embodiments of this invention are described with reference to the drawings, however the present invention is not limited to the illustrated embodiments. Various modifications may be made to the illustrated embodiments within the same scope of this invention, or within an equivalent scope.

INDUSTRIAL APPLICABILITY

According to this invention, it is possible to provide a scour prevention unit in which no suction of sand occurs from below a placement surface. Hence, this invention can be used advantageously as a facility for scour prevention.

REFERENCE SIGNS LIST

10 Scour prevention unit
11 Bag body
12 Block objects
13 Bag material
16 Cloth
18 Fixing means
120 Seabed

The invention claimed is:

1. A scour prevention unit comprising:
a bag body housing block objects in a bag material; and
a cloth outside the bag body and fixed to an exterior of the bag body,
wherein
the cloth is below the block objects and fixed to the exterior of the bag body by at least one fastener,
the at least one fastener comprises a string attached to the cloth and a hook attached to the bag body, and
the combination of the bag body, the block objects and the cloth is configured to prevent scouring of a seabed and passage of sand particles of the seabed through the bag body.

2. The scour prevention unit according to claim 1, wherein the cloth is a sheet comprising at least one of a woven fabric, knitted fabric, lace, felt, or a nonwoven fabric.

3. The scour prevention unit of claim 1, wherein the bag body comprises a lower portion and an upper portion over the lower portion, the cloth is below the lower portion of the bag body, and the upper portion of the bag body is free from being covered by the cloth.

4. A scour prevention unit comprising:
a plurality of bag bodies, each of the bag bodies comprising a bag material and separately housing block objects in the bag material; and
a single cloth sheet outside the pluralities of bag bodies and fixed to an exterior of each of the bag bodies, wherein the cloth sheet is below the block objects housed by the plurality of bag bodies and fixed to the exterior of each of the bag bodies by at least one fastener, the at least one fastener comprises a string attached to the cloth and a hook attached to the bag body, and the combination of the bag bodies, the block objects and the cloth sheet is configured to prevent scouring of a seabed and passage of sand particles of the seabed through the bag bodies.

5. The scour prevention unit of claim 4, wherein each bag body of the plurality of bag bodies comprises a lower portion and an upper portion over the lower portion, the cloth sheet is below the lower portion of each bag body of the plurality of bad bodies, and the upper portion of each bag body of the plurality of bag bodies is free from being covered by the cloth sheet.

6. A scour prevention method comprising:

a step of preparing a bag body housing block objects in a bag material; and a step of fixing a cloth outside the bag body to an exterior of the bag body by way of at least one fastener, wherein the at least one fastener comprises a string attached to the cloth and a hook attached to the bag body, and the combination of the bag body, the block objects and the cloth prevents scouring of a seabed and passage of sand particles of the seabed through the bag body.

7. The scour prevention method of claim 6, wherein the bag body comprises a lower portion and an upper portion over the lower portion, and fixing the cloth outside the bag body and below the block object by way of the at least one fastener includes attaching the cloth to the lower portion of the bag body such that the upper portion of the bag body is free from being covered by the cloth.

* * * * *